US010570557B2

(12) United States Patent
Lv et al.

(10) Patent No.: US 10,570,557 B2
(45) Date of Patent: Feb. 25, 2020

(54) TUMBLE DRYER AND A DRYING METHOD

(71) Applicant: QINGDAO HAIER DRUM WASHING MACHINE CO., LTD., Qingdao, Shandong (CN)

(72) Inventors: Peishi Lv, Shandong (CN); Sheng Xu, Shandong (CN); Huacheng Song, Shandong (CN); Junming Yin, Shandong (CN)

(73) Assignee: QINGDAO HAIER DRUM WASHING MACHINES CO., LTD., Qingdao, Shandong (CN)

( * ) Notice: Subject to any disclaimer, the term of this patent is extended or adjusted under 35 U.S.C. 154(b) by 406 days.

(21) Appl. No.: 15/500,862

(22) PCT Filed: Sep. 29, 2014

(86) PCT No.: PCT/CN2014/087823

§ 371 (c)(1),
(2) Date: Jan. 31, 2017

(87) PCT Pub. No.: WO2016/015377

PCT Pub. Date: Feb. 4, 2016

(65) Prior Publication Data

US 2017/0218562 A1 Aug. 3, 2017

(30) Foreign Application Priority Data

Aug. 1, 2014 (CN) ..... 2014 1 0376658
Aug. 1, 2014 (CN) ..... 2014 1 0378223

(51) Int. Cl.
*D06F 58/04* (2006.01)
*D06F 58/28* (2006.01)
(Continued)

(52) U.S. Cl.
CPC ..... *D06F 58/04* (2013.01); *D06F 58/02* (2013.01); *D06F 58/28* (2013.01); *D06F 58/10* (2013.01);
(Continued)

(58) Field of Classification Search
CPC .. D06F 2058/2864; D06F 58/02; D06F 58/04; D06F 58/10; D06F 58/20; D06F 58/28
See application file for complete search history.

(56) References Cited

U.S. PATENT DOCUMENTS 2,716,820 A * 9/1955 Bourner ..... D06F 58/02 126/4
3,882,613 A * 5/1975 Wilson ..... D06F 58/02 34/552
(Continued)

FOREIGN PATENT DOCUMENTS

CN 1970871 A 5/2007
CN 102277708 A 12/2011
(Continued)

OTHER PUBLICATIONS

International Search Report (PCT/ISA/210) dated Apr. 22, 2015, by the Chinese Patent Office as the International Searching Authority for International Application No. PCT/CN2014/087823.
(Continued)

*Primary Examiner* — Jorge A Pereiro
*Assistant Examiner* — Logan P Jones
(74) *Attorney, Agent, or Firm* — Buchanan Ingersoll & Rooney PC

(57) ABSTRACT

A clothes dryer comprises an inner drum, an outer drum, an air heating and supplying means and an air duct, and at least two air chambers each in communication with the air duct. The air chambers are respectively arranged corresponding to two sides along which clothes rise or fall as the inner drum
(Continued)

rotates, the air chamber at one side starts supplying air and the air chamber at the other side stops supplying air according to a rotation direction of the inner drum, all air chambers are distributed in the order of front and rear of the outer drum in an axial direction, and the rotation direction of the inner drum is controlled according to the distribution of the air chambers, such that air is supplied in different positions corresponding to the front part and the rear part of the inner drum at different clothes drying stages, in order to dry clothes.

15 Claims, 8 Drawing Sheets

(51) Int. Cl.
*D06F 58/02* (2006.01)
*D06F 58/20* (2006.01)
*D06F 58/10* (2006.01)

(52) U.S. Cl.
CPC ..... *D06F 58/20* (2013.01); *D06F 2058/2864* (2013.01)

(56) References Cited

U.S. PATENT DOCUMENTS 3,995,988 A * 12/1976 Freze ..... D06F 58/263 432/21
4,689,896 A 9/1987 Narang
4,811,495 A * 3/1989 Huang ..... D06F 58/02 34/131
5,212,969 A * 5/1993 Tsubaki ..... D06F 25/00 34/596
5,555,645 A * 9/1996 Joslin ..... D06F 58/28 34/427
5,649,372 A 7/1997 Souza
6,678,969 B1 * 1/2004 Hong ..... D06F 58/02 34/108
8,209,879 B2 * 7/2012 Chernetski ..... D06F 58/203 34/389
2006/0254082 A1 * 11/2006 Kim ..... D06F 58/02 34/595
2012/0005918 A1 * 1/2012 Kim ..... D06F 58/28 34/491
2012/0159808 A1 6/2012 Nakamoto et al.

FOREIGN PATENT DOCUMENTS

CN 102330316 A 1/2012
CN 102482839 A 5/2012
CN 102733146 A 10/2012
CN 102851925 1/2013
JP H08-229298 A 9/1996
JP 4444016 B2 3/2010
JP 2010-104487 A 5/2010
JP 2011-115413 A 6/2011
JP 2011115413 A * 6/2011
JP 2012-085776 A 5/2012
JP 2013-128541 A 7/2013
WO 2004/048673 A2 6/2004

OTHER PUBLICATIONS

Written Opinion (PCT/ISA/237) dated Apr. 22, 2015, by the Chinese Patent Office as the International Searching Authority for International Application No. PCT/CN2014/087823.
Extended European Search Report dated Jan. 23, 2018, issued by the European Patent Office in corresponding European Application No. 14898555.9. (9 pages).
Office Action (Notification of Reasons for Refusal) dated May 8, 2018, by the Japanese Patent Office in corresponding Japanese Patent Application No. 2017-502989 and English translation of the Office Action. (8 pages).

* cited by examiner

TUMBLE DRYER AND A DRYING METHOD

FIELD OF THE INVENTION

The present disclosure relates to the field of drying, particularly to a tumble dryer for improving the air intake position and the air intake mode and a drying method.

BACKGROUND OF THE INVENTION

In a drying mechanism for a washing and drying machine, the means for generating heated air is a heating system for heating the air by a heater. In order to reduce energy consumption, developed a heat pump dryer, the use of heat pump system to strengthen the heat recycling. The existing tumble dryer is provided with, only a drying air inlet at the front of a dryer in a drying method of the general drying tube drying method (see FIG. 1), only a drying air inlet at the back of a dryer in the heat pump drying method (see FIG. 2).

Specifically, as shown in FIG. 1, the conventional heating tube clothes drying method is a method in which a heating pipe 1' and a fan 2' are provided in the air duct, and the circulation type heating is further provided with a condensing device 3', the water vapor in the hot and humid air needs to be condensed and drained before the heating; the non-circulating drying air method is that air is heated outside and carried out into the drum, and the hot and humid air is discharged to the outside after the drying (not shown in the Fig). As shown in FIG. 2, the conventional heat pump type clothes dryer is provided with an air circulation passage in which the heater air heated by the condenser 5' flows through the circulation passage from the rear air inlet of the drum into the drying chamber that loaded with clothes. The moisture-absorbed air taken from the clothes is sent back to the evaporator 6' by the front air outlet for dehumidification, and the dehumidified air is again heated by the condenser 5' and fed into the drying chamber.

A Chinese patent application No. 200610146442.2 discloses a washing dryer using a heat pump as a heat source. In particular, it relates to a device for heating air by using a heat source of a condenser in a heat pump system, drying the clothes using an evaporator in the system as a dehumidifying and cooling source. On the rear side of the outer barrel of the washing machine is provided with a hot air inlet, and the front end of the outer barrel of the drum is provided with a hot air outlet, the hot air outlet with an air duct is communicated with the hot air inlet, an evaporator is placed in the air channel near the hot air outlet and set in the air duct near the hot air inlet.

A Chinese patent application No. 201110183197.3 discloses an inner and outer cylinder structure having a drying function washing machine. The inner cylinder is coaxially arranged inside the outer cylinder, and the inner cylinder shaft passes through the rear part of the outer cylinder. The rear part of the outer cylinder is provided with a drying air inlet, and the outer periphery of the drying air inlet between the inner side of the rear part of the outer cylinder and the outer part of the inner part of the inner cylinder is provided with anti-radial air diffusing windshield structure. Wherein the windshield structure is a plurality of ribs which are respectively provided in the inner side of the rear part of the outer cylinder and the outer side of the outer part of the inner cylinder in the circumferential direction and the ribs are on the periphery of the drying air inlet, and The ribs have different radii so that the adjacent ribs on the inner side of the rear portion of the outer cylinder and the outer portions of the rear portion of the inner cylinder are staggered.

Whether drying clothes by the heater or by the heat pump system, the heated air is generally supplied from the rear of the outer drum to the inner drum through the air duct. After the heat exchange with the wet clothes, the humidified air is discharged from the front of the inner drum or condensed to dehumidify and then circulated to dry clothes. Dryers are equipped with only one drying inlet, during the drying process, clothes close to the inlet dry faster, but clothes will shrink for staying in a high temperature for a long time. Clothes far away from the inlet are not easy to dry for a lower temperature, especially one piece with high weight clothing, prone to uneven internal drying under this situation.

A Chinese patent application No. 201110231574.6 discloses washing dryer with a front and a rear double drying air inlets and a control method thereof. The washing dryer includes an outer shell, an outer cylinder arranged inside the outer shell and an inner cylinder rotatable inside the outer cylinder, and a heat pump system for drying clothes. The heat pump system comprises a heat pump air inlet and a heat pump air outlet. The front and rear parts of the outer cylinder are provided with a front drying inlet and a rear drying inlet, respectively, and a drying air outlet is arranged at the top of the outer cylinder. And the drying air outer is communicated with the heat pump air inlet through the inlet air duct, the heat pump air outlet is communicated with the rear drying inlet through an air supply duct, and the second air duct is arranged between the front air inlet and the air supply duct. And a second air duct is arranged between the front drying air inlet and the air supply air duct. The second air duct that in close contact with the outer wall of the outer cylinder is formed integrally with the outer cylinder. The air outlet of the heat pump is controlled by the switching mechanism to be connected with the front drying inlet and/or to the rear drying inlet.

Although the above-described structure discloses two air inlets, it is essentially one air inlet which is controlled by the switching mechanism to select one to intake air. And the front air inlet and outlet are set in the front of the outer cylinder. When choosing the front air inlet, it can not effectively use the intake air to dry clothes, the purpose is to regulate the heat pump compressor efficiency. The two air inlets are arranged at the front and rear ends of the outer cylinder, and the drying of the clothes is uneven no matter which air inlet is selected, and the clothes are seriously damaged.

In view of the foregoing, the present invention is proposed.

SUMMARY OF THE INVENTION

The technical problem to be solved by the present disclosure is to overcome the shortcomings of the prior art and a tumble dryer for controlling the direction of air intake is provided so that the hot air is selectively blown into the drum from the left or right side of the drum corresponding to the clothes rising or falling to make the clothes evenly be dried and shorten the drying time.

Another object of the present disclosure is to provide a drying method for controlling the rotation direction of the inner drum so that the sides along which clothes lift and fall cooperate air chambers in the fore-and-aft axial direction of the outer drum to intake hot air.

It is a further object of the present disclosure to provide tumble dryer which adds an auxiliary drying system based on the existing drying method for blowing air from the front and rear side to control the intake direction of air intake so that the hot air is selectively blown into the drum from the left or right side of the drum corresponding to the clothes rising or falling to make the clothes evenly dried and shorten the drying time.

In order to solve the above-mentioned technical problems, the basic idea of the present invention adopts the technical scheme: a tumble dryer, comprising an inner drum, an outer drum, an air heating and supplying means and a duct, and further comprising at least two air chambers for blowing hot air from a side wall of the outer drum to the inner drum, each air chamber being communicated with the air duct and controlled to open and close independently, the air chambers being respectively arranged corresponding to two sides along which clothes rise or fall as the inner drum rotating, wherein the air chamber at one side is controlled to start supplying air and the air chamber at the other side to stop supplying air according to a rotation direction of the inner drum.

Preferably, according to the rotation direction of the inner drum, control a blowing direction of the air chamber during drying clothes. The air chamber at a side along which clothes fall starts supplying air and the air chamber at a side along which clothes rise stops supplying air.

Further, all air chambers are distributed in the order of front and rear of the outer drum in an axial direction.

Further, an opening and closing of each air chamber and the rotation direction of the inner drum are controlled in accordance with a drying time and/or a temperature inside the outer drum and/or a humidity of the clothes.

Further, at least one air chamber is provided corresponding to the side along which the inner drum drives the clothes to rise and fall, the opening and closing of the air chambers on both sides are switched according to forward and reverse rotation of the inner drum.

Further, the dryer comprises a first air chamber and a second air chamber which are respectively located on a left side and a right side of the outer drum. An air supply direction respectively corresponds to a rising and falling path of the clothes driven by a rotation of the inner drum. During drying, the inner drum rotates forwardly and reversely, the opening and closing of the air chambers is switched, which meet conditions: the air chamber corresponding to a clothes falling path is open to supply air, the air chamber on the other side is closed.

Further, the dryer also comprises a third air chamber, the third air chamber is installed on a bottom of the outer drum, a blowing direction is upward.

Further, the first chamber and the second chamber are respectively located at a front end and a rear end of the outer drum, the third air chamber is arranged in a middle.

Further, a one-way valve is provided on an inlet pipe of each air chamber, and each chamber is in communication with the air duct through a same air distribution valve. The air chambers are controlled to blow by the air distribution valve, or, each air chamber is respectively connected with the air duct, and each air chamber is correspondingly provided with an open control valve.

Further, the air chamber comprises an air inlet and an opening, and a vent cover for blowing air is arranged on the opening, the vent cover is evenly distributed with a plurality of vent holes.

A drying method of the tumble dryer of the present disclosure, all air chambers are distributed in the order of front and rear of the outer drum in an axial direction, a rotation direction of the inner drum is controlled according to the distribution order of each air chamber so as to supply air in front or rear positions of the inner drum for drying in different drying stages.

Further, at least two stages are comprised, an early drying stage and a late drying stage. The air chamber which blows air from a left side of the outer drum is also located at the rear end of the outer drum, and the air chamber which blows air from a right side of the outer drum is also located at the front end of the outer drum. During the early drying stage, the inner drum rotates counterclockwise for the whole stage or most of the time, the clothes on the left side fall, and the air chamber on the left side is open to supply air, the air chamber on the right side is closed. During the late drying stage, the inner drum rotates clockwise for the whole stage or most of the time, the clothes on the right side fall, the air chamber on the right side is open to supply air, the air chamber on the left side is closed. The control method allows the intake of air at different position in different stages to avoid fibers of local clothes losing their elasticity due to over-drying or easily being broken or worn out.

Further, a lower air chamber is provided at a middle position on a lower part of the outer drum, the lower air chamber cooperates with the air chambers on both left and right sides of the outer drum to dry the clothes during the early and late drying stages; or, a mid-drying stage is added, the lower air chamber is open during the mid-dryings stage, and the air chambers on the left and right sides of the outer drum are closed.

The present disclosure realizes quick and uniform drying by controlling the rotating direction and rotation time of the inner drum according to a pattern that a positional distribution of the air chambers in the axial direction and a circumferential direction of the outer drum and the opening and closing of the air chambers as the clothes are driven to rise and fall by the rotation of the inner drum.

A tumble dryer of the present disclosure, comprising an inner drum, an outer drum and a first drying system in which air is blown in from a front/rear of the outer drum, also comprising a second drying system. The second drying system comprises at least two air chambers for blowing hot air from a side wall of the outer drum to the inside, each air chamber is arranged on one side along which the clothes rise when the inner drum is rotated forwardly and reversely, and each air chamber is independently controlled to blow hot air in, and the air chambers on both sides are switched on and off according to a forward and reverse rotation of the inner drum.

Further, the first drying system is a main drying system, and the second drying system is an auxiliary drying system. During drying, the second drying system controls the opening and closing of the air chambers with the first drying system to complete the drying.

Further, each air chamber is distributed in the order of front and rear in an axial direction of the outer drum.

Further, each air chamber is distributed in the circumferential direction of the outer drum.

Further, an opening and closing of each air chamber is controlled in accordance with a drying time and/or a temperature inside the outer drum and/or a humidity of the clothes.

Further, the second drying system comprises a first air chamber and a second air chamber. The two air chambers are respectively located on a left side and a right side of the outer drum, and correspond to a rising and falling path of the clothes driven by a rotation of the inner drum. During drying, the inner drum rotates forwardly and reversely, the opening and closing of the air chambers is switched, which meet conditions the air chamber corresponding to a clothes falling path is open to supply air, the air chamber on the other side is closed.

Further, the second drying system comprises a third air chamber, the third air chamber is installed on a bottom of the outer drum, and a blowing direction is upward.

Further, the first chamber and the second chamber are respectively located at a front end and a rear end of the outer drum.

Further, a one-way valve is provided on an inlet pipe of each air chamber, each air chamber is in communication with the air duct through a same air distribution valve, and the air chambers are controlled to blow by an air distribution valve. Or, each air chamber is respectively communicated with the air duct, and each air chamber is correspondingly provided with an open control valve.

Further, the second drying system shares a drying means with the first drying system, and air is diverted to the first drying system and the second drying system through an air duct. Or, the second drying system and the first drying system are respectively corresponding to a heating means.

Further, the air chamber comprises an air inlet and an opening, and a vent cover for blowing air is arranged on the opening, the vent cover is evenly distributed with a plurality of vent holes.

Further, determine whether each air chamber needs to open or not in accordance with a drying time and/or a temperature inside the outer drum and/or a humidity of the clothes, and so as to control the rotation direction of the inner drum to open and close corresponding air chambers.

By adopting the technical proposal, the disclosure has the following beneficial effects compared with the prior art.

The tumble dryer according to the present disclosure improves the air intake mode of the drying and intakes the air from the side wall of the outer drum, which replaces the front or rear air intake system of the existing dryer. Hot air blown in from air chambers at different locations increases the ways of hot air intake and achieves the position controllable for drying the clothes. By controlling the rotation direction of the drum and the opening and closing of the corresponding air chamber, it is achieved to enhance drying effect, make the clothes dry more uniform. In addition, by periodically blowing air from the front and rear in the axial direction of the outer drum, the drying time is shortened and the uniformity effect of drying is enhanced. Evenly drying the clothes when they falling, the clothes are fluffy, not easily hurt and not easy to fold, it overcomes the problem of uneven heating and drying for too long under the method of single front or rear air inlet.

Experiments show that the dryer according to the present disclosure can save 10%-30% time according to different load, especially for large-capacity dryers, according to different clothing, can save time 10-30 minutes. The above-mentioned improvement of the present disclosure can improve the drying efficiency of about 20%, the drying uniformity and the relative reduction of the damage of the clothing fiber.

In particular, an auxiliary drying system is increased based on the existing drying system with front and rear air intake and air is drawn from the side wall of the outer drum. Hot air is blown in from air chambers at different locations, which increases the ways of hot air intake and achieves the position controllable for drying the clothes. By controlling the rotation direction of the drum and the opening and closing of the corresponding air chamber, it is achieved to enhance drying effect, make the clothes dry more uniform. In addition, by periodically blowing air from the front and rear in the axial direction of the outer drum, the drying time is shortened and the uniformity effect of drying is enhanced. During the rising process of the clothes, the clothes are in close contact with the inner drum and the hot air from the outer circumferential wall of the outer drum does not affect the original air duct of the inner drum. The hot air heats the inner drum wall to dry the clothes close to the inner drum wall. Drying clothes from different angles and the clothes are fluffy, not easily hurt and not easy to fold, it overcomes the problem of uneven heating and drying for too long under the method of single from or rear air inlet.

DETAILED DESCRIPTION OF THE INVENTION

Specific embodiments of the present disclosure are further described below in detail with reference to the accompanying drawings.

Figure 3:
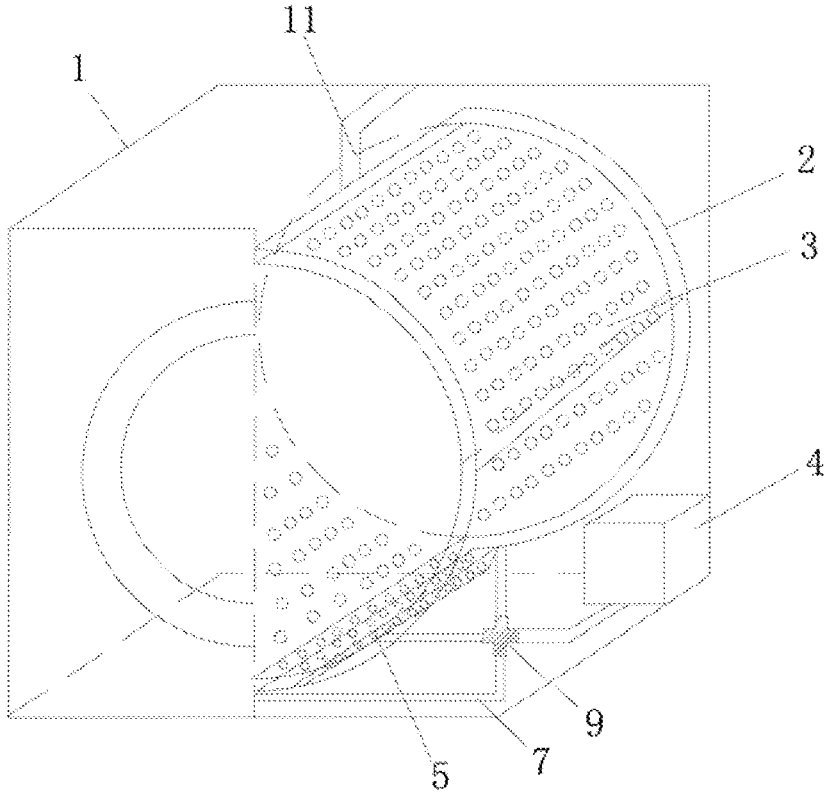
FIG. 3 and FIG. 4 are schematic diagrams of dryers with different air ducts of the present disclosure.
Figure 4:
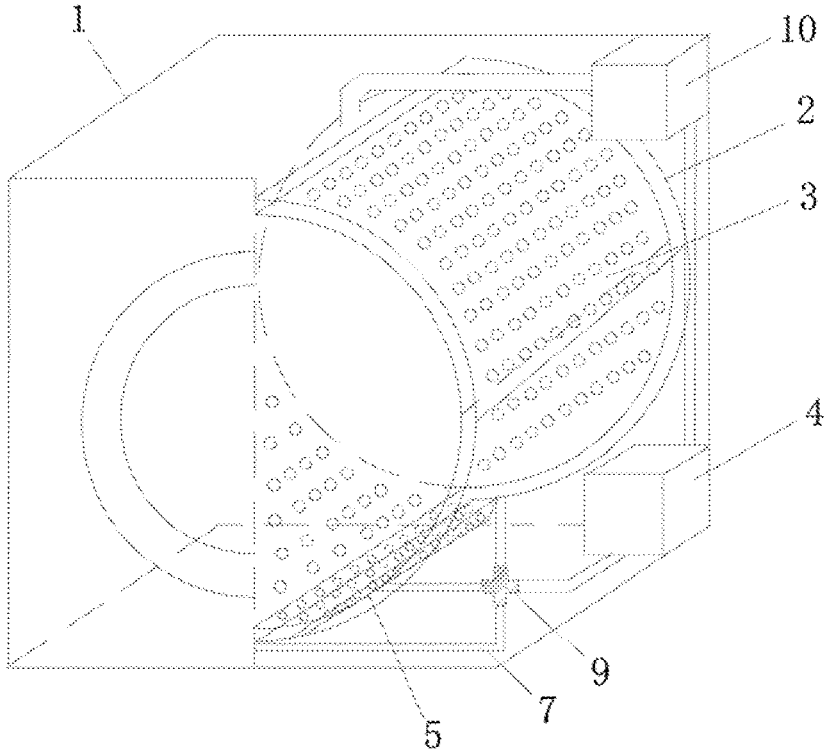

As shown in FIG. 3 and FIG. 4, a dryer of the present disclosure comprises a casing 1, an outer drum 2 provided in the casing, an inner drum 3 rotatably provided in the outer drum, a heating and supplying means 4, a duct, a drive device for driving the rotation of the inner drum, and other control structures and the like (not shown) of a conventional dryer. The heating and supplying means 4 includes a heating unit and an air supplying unit, and the heating unit may employ an electric heater structure or a heat pump structure for heating the air in the air duct; the air supplying unit is an air pump or an air blower for feeding the heated air into the outer drum or extracting the hot and humid air after heat exchange with the clothes in the outer drum. In addition to the above-mentioned conventional structure, the present disclosure further comprises at least two air chambers 5 provided on a peripheral wall of the outer drum 2, supplying hot air to the drum, and communicating with the air duct. Each air chamber 5 is independently opened and closed to supply hot air, and the air chambers 5 are respectively provided on both sides along which the clothes is driven to rise and fall by the inner drum 3 rotating. The air chamber 5 is at one side is switched on according to the rotational direction of the inner drum 3, air chamber at the other side stop supplying the air. Specifically, in the drying process, according to the rotation, direction of the inner drum, the air chamber, of which the blowing direction is corresponding to the side along which the clothes fall, is controlled to open to supply air, and stop supplying air on the side along with the clothes rise. The change of the rotating direction of the inner drum causes the change of the sides along which the clothes rise and fall, therefore, the air chambers are controlled to open and close according to the direction of the rotation. However, the above rule is not fixed, it can be open to supply air on the side along which the clothes rise, on the other side it be off.

The air chambers according to the present disclosure are not necessarily located on the same circumferential cross-section of the outer drum, and each air chamber may be distributed in the order of front and rear in the axial direction of the outer drum. The opening and closing of each air chamber and the rotation direction of the inner drum are controlled in accordance with a drying time and/or a temperature inside the outer drum and/or a humidity of the clothes. It can be better to reduce the damage to clothing fibers, to achieve rapidly and uniformly drying The heating unit for tumble dryers according to the present disclosure employs a heater or a heat pump system or other structures such as a solar heating structure. The duct employs an internal condensing-heating circulation structure or a structure in which hot and humid air is discharged to the outside after drying (see FIG. 3 and FIG. 4). As shown in FIG. 4, when the dryer adopts the internal condensing-heating circulation and structure, there is provided a condensing unit 10. As shown in FIG. 3, when the structure in which hot and humid air is discharged to the outside after drying is adopted, the outer drum 2 is provided with an exhaust port 11.

Embodiment 1

Figure 5:
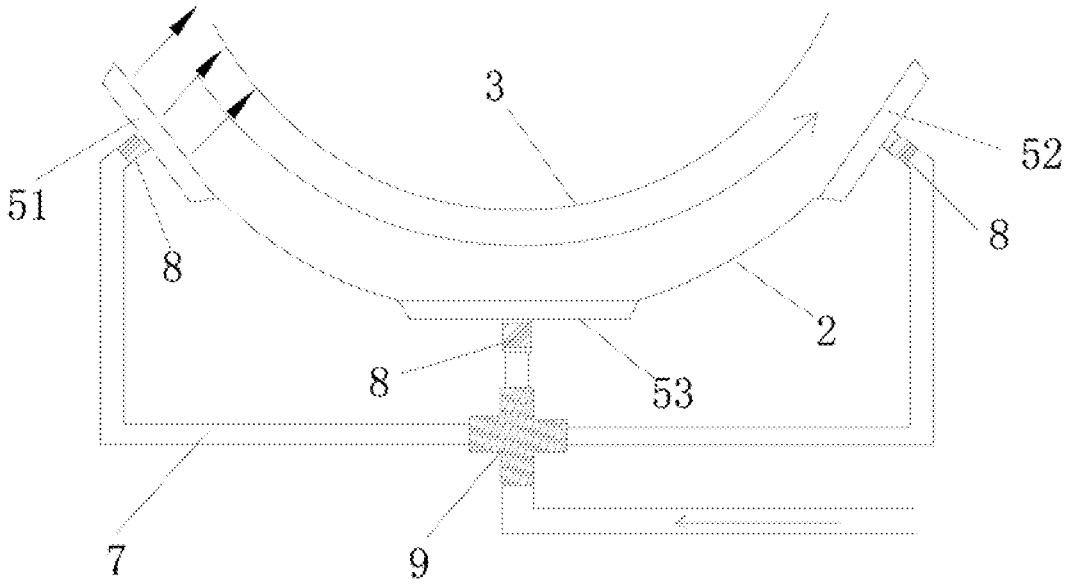
FIG. 5 is a schematic diagram of a mounting structure of air chambers and an outer drum of the present disclosure.
Figure 8:
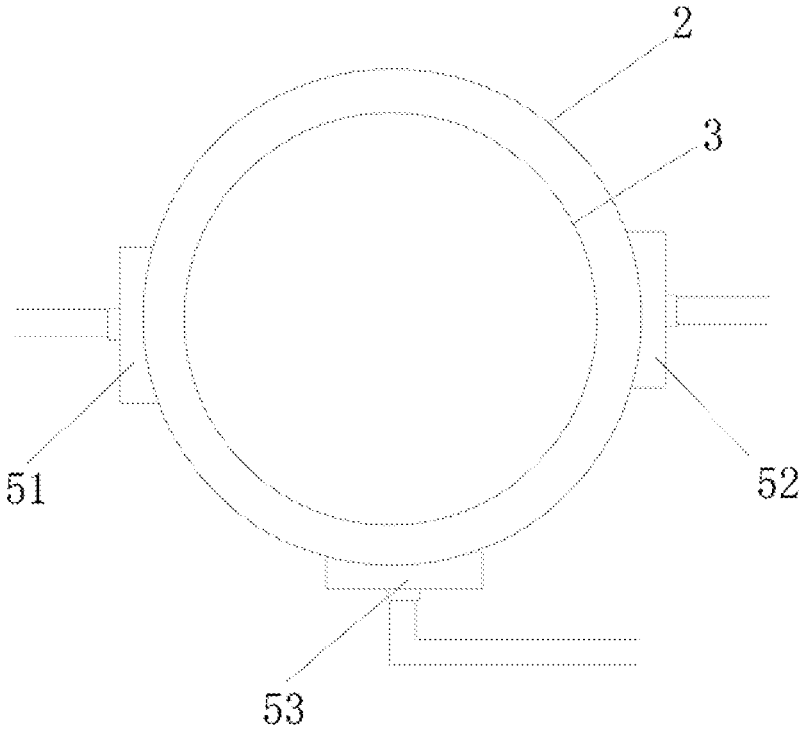
FIG. 8 to FIG. 10 are diagrams of different embodiments of mounting structures of the air chambers and an outer drum of the present disclosure.

As shown in FIG. 5 and FIG. 8, the dryer of the present embodiment includes a first air chamber 51 located on the left side of the outer drum 2, and a second air chamber 52 located at the right side of the outer drum 2, the left side and the right side of the outer drum 2 are defined with respect to the direction in which the user faces to the clothes dispensing opening of the dryer. The air supply direction respectively corresponds to the rising and falling path of the clothes by the rotation of the inner drum, that is, the inner drum is switched between the forward and reverse rotation, and the first air chamber 51 and the second air chamber 52 correspond to the rising and falling paths of the clothes.

During the drying process, when the inner drum 3 is rotated forwardly which is clockwise, the clothes rise on the left side of the inner drum 3, and fall on the right side of the inner drum 3. At this time, the second air chamber 52, which blows air corresponding to the clothes drop side path, is opened, and the first air chamber 51 on the other side is closed (see FIG. 9). On the other hand, when the inner drum 3 rotates reversely which is counterclockwise, the clothes rise on the right side of the inner drum 3, and fall on the left side of the inner drum 3. At, this time, the first air chamber 51, which blows air corresponding to the clothes drop side path, is opened, and the second air chamber 52 on the other side is closed (see FIG. 5). The first air chamber 51 and the second air chamber 52 are repeatedly switched on and off in response to the forward and reverse rotation of the inner drum.

Embodiment 2

As shown in FIG. 5 and FIG. 8, the dryer of the present embodiment is further provided with a third air chamber 53 on the basis of the embodiment 1, the third air chamber 53 is arranged at a bottom of the outer drum 2, that is, directly below, and the blowing direction is upward. Regardless of whether the inner drum 3 is rotated forwardly or reversely, the clothes always fall in the lower part and lifts upwardly from the lower part, and the angles at which each clothes fall are different. Therefore, the third air chamber 53 can supply hot air continuously or intermittently for a long period of time, and the drying time can be further saved.

Embodiment 3

Figure 11:
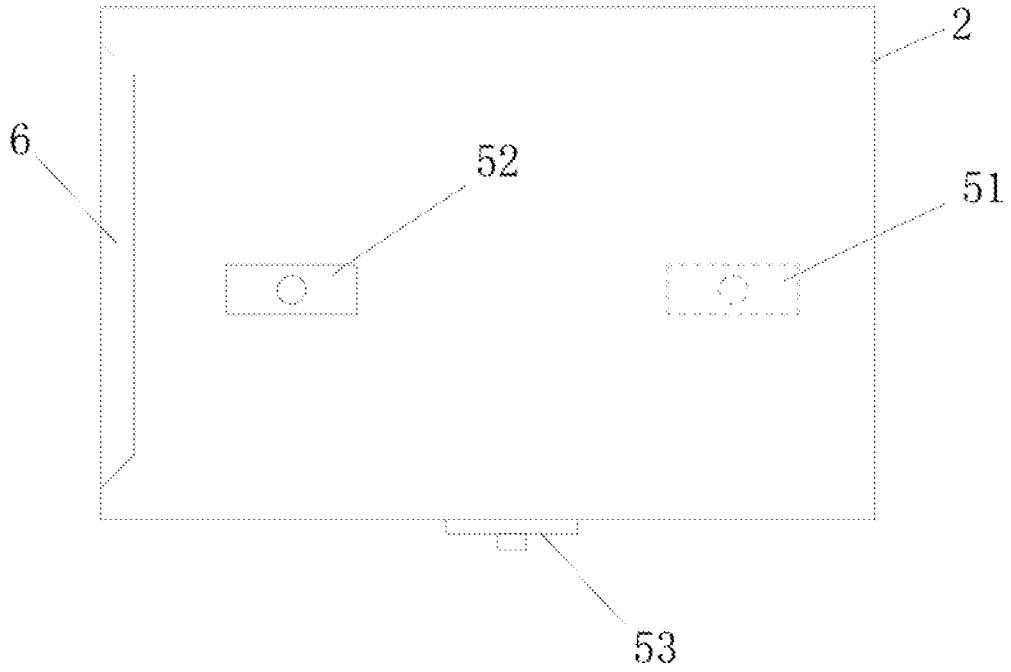
FIG. 11 is a schematic diagram of air chambers axially mounted on an outer drum of the present disclosure.

As shown in FIG. 11, the clothes dryer of the present embodiment is further improved on the basis of the embodiment 1, and the first air chamber 51 is located on the left side of the outer drum 2 and rear end thereof in the axial direction, and is opposite to the end of the clothes dispensing opening 6. The second air chamber 52 is located on the right side of the outer drum 2 and front end thereof in the axial direction, and is close to the end of the clothes dispensing opening 6. The two chambers cover at least 60% of the area in the axial direction. During the drying process, the inner drum is switched to rotate forwardly and reversely, and the first air chamber and the second air chamber are open/close corresponding to the clothes rising and falling. It achieves that air intake from the side wall of the outer drum at the front and rear ends of the outer drum and makes clothes evenly dry and not cause damage to clothes, drying time is also reduced.

Further, in combination with the embodiment 2, the third air chamber 53 provided on the outer drum is located at the bottom of the outer drum 2 and in the axial middle position, that is, the third air chamber 53 is located at a position between the first air chamber 51 and the second air chamber 52 in the axial direction of the outer drum 2. The three chambers cover at least 80% of the area in the axial direction, or cover completely. The opening and the closing of the first air chamber and the second air chamber is controlled according to the clothes rising and falling which is driven by the rotation direction, the third air chamber can supply hot air continuously or intermittently for a long period of time.

The first air chamber and the second air chamber are not fixed at the rear left end or the front right side in the present embodiment, they may be arranged at the front left end or the rear right end. Or the third air chamber is at the front and rear ends, the first air chamber or the second air chamber is in the middle or other positions.

Embodiment 4

Figure 9:
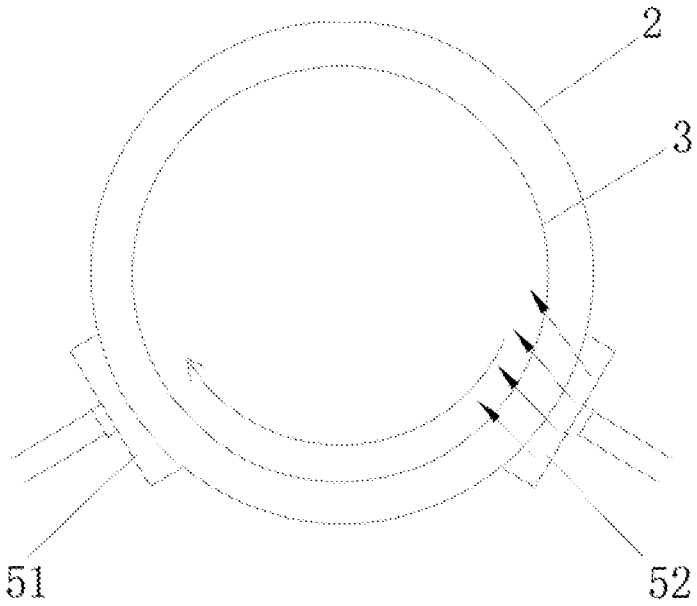

As shown in FIG. 5 and FIG. 11, on the basis of the embodiment 3, in the early drying stage, the inner drum 3 of the clothes dryer rotates counterclockwise or rotates counterclockwise most of the time. The rotation of the inner drum 3 causes the clothes to tumble, and the clothes fall on the left side of the inner drum 3 and rise on the right side, and the clothes are in a stacked state on the right side. The first air chamber 51 opening and the second air chamber 52 closing, air intake from the rear end near the left side of the outer drum 2 so that the clothes at the rear side of the inner drum 3 is quickly dried. As shown in FIG. 9 and FIG. 11, in the late drying stage, the inner drum 3 of the clothes dryer rotates clockwise or rotates clockwise most of the time. The rotation of the inner drum 3 causes the clothes to tumble, the clothes fall on the right side of the inner drum 3 and the clothes on the left side are in a stacked state. The second air chamber 52 opening and the first air chamber 51 closing, air intake from the front end near the right side of the outer drum 2 so that the clothes on the front side of the inner drum 3 are collectively dried. The control method allows the intake of air at different positions and in different stages to avoid fibers of local clothes losing their elasticity due to over-drying or easily being broken that causes the clothes to be worn out.

Further, a mid-drying stage can be added, controls the opening/closing switching of the first air chamber 51 and the second air chamber 52 and adjust the proportion of time in which the inner drum rotates forward and backward. Or the third air chamber 53 is opened in the mid-drying stage and the first air chamber 51 and the second air chamber 52 on the left and right sides are closed. Or the third air chamber 53 respectively cooperates with the first air chamber 51 and the second air chamber 52 to blow air drying in the mid-drying stage.

Drying time segment can be separated in accordance with the temperature rise stage, the temperature stable stage and the second stage of temperature rise of the existing drying process, or according to the detected humidity or temperature changes. For example: in the early drying stage, the heat of the drying clothes causes the temperature to rise rapidly to about 50° C.; then the rising rate of the temperature is slow and steady. This stage is the period when the water vapor evaporates most, the heat is absorbed by the water and water is evaporated, while the temperature inside the drum rises relatively slowly. In the late drying stage, only a small amount of water is inside the drum, the temperature rise rate inside the drum will once again sharply increase, this time means close to the end of drying.

As shown in from FIG. 12 to FIG. 15, they are schematic diagrams of another tumble dryer of the present disclosure. The tumble dryer comprises a casing 1, an outer drum 2 provided in the casing, an inner drum 3 rotatably provided in the outer drum, a heating and supplying means 4, a condensing unit 10, a duct 11, a drive device for driving the rotation of the inner drum, and other control structures and the like (not shown) of a conventional dryer. The heating and supplying means 4 includes a heating unit 41 and an air supplying unit 42, and the heating unit may employ an electric heater structure or a heat pump condensing structure for heating the air in the air duct 11; the air supplying unit 42 is an air pump or an air blower for feeding the heated air into the outer drum 2 or extracting the hot and humid air after heat exchange with the clothes in the outer drum 2. The above-mentioned conventional air drying systems with front and rear air inlet and outlet belong to the first drying system of the present disclosure. In addition to the above-mentioned conventional structure, a second drying system is provided in the present disclosure. Wherein, the first drying system is a main drying system and the second drying system is an auxiliary drying system. The second drying system comprises at least two air chambers 5 provided on the peripheral wall of the outer drum 2, supplying hot air to the drum, communicating with the air duct. Each air chamber 5 is independently opened and closed to supply hot air, and the air chambers 5 are respectively provided on both sides along which the clothes are driven to rise and fall by the inner drum 3 rotating. The second drying system controls opening and closing the air chambers with the first drying system to complete drying process. The air chamber 5 at one side is switched on and off according to the rotational direction of the inner drum 3, and air chamber at the other side stop supplying the air. Specifically, in the drying process, according to the rotation direction of the inner drum, the air chamber is controlled to open to supply air corresponding to the side along which the clothes rise, and stop supplying air on the side along which the clothes fall. The change of the direction of the rotation of the inner drum causes the change of the sides along which the clothes rise and fall, therefore, the air chambers are controlled opening and closing according to the direction of the rotation. However, the above rule is not fixed, it can be open to supply air on side along which the clothes fall, on the other side it be off.

Figure 12:
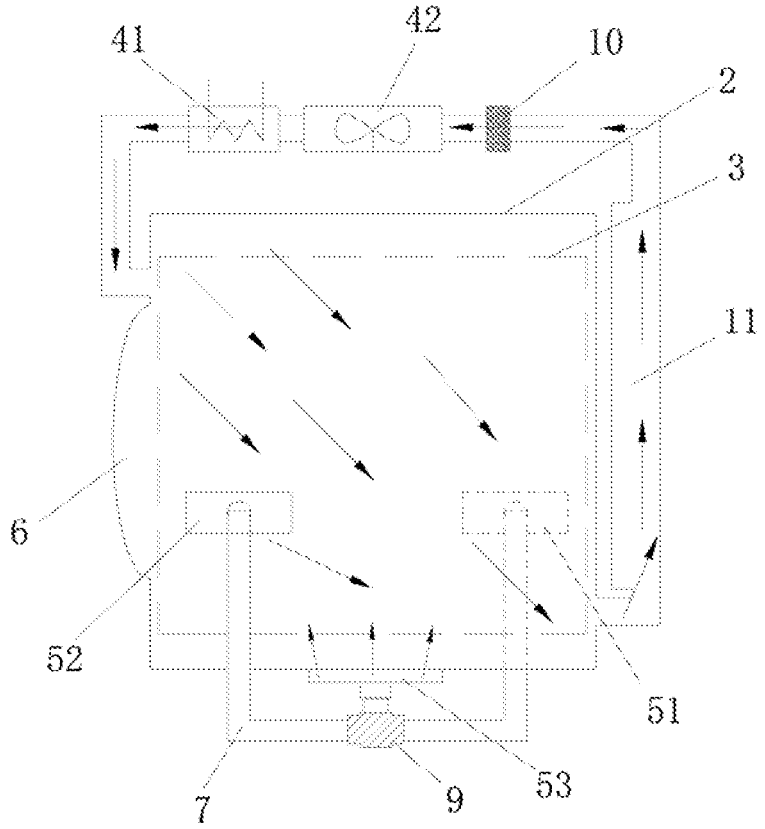
FIG. 12 and FIG. 13 are schematic diagrams of a second drying system of another tumble dryer cooperating with different first drying systems of the present disclosure.
Figure 13:
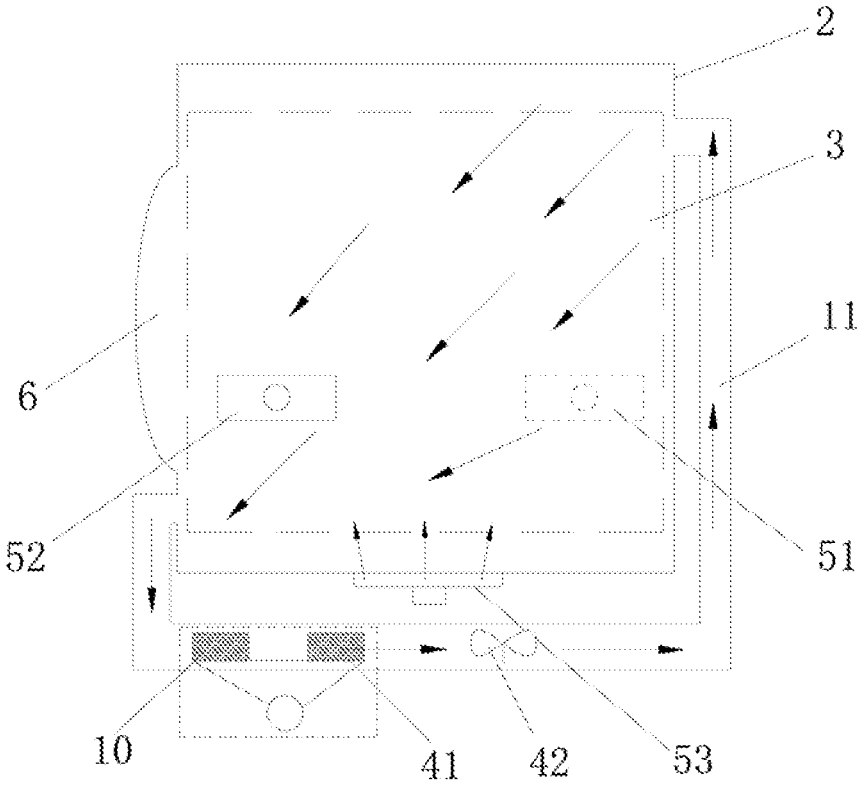

The heating unit for the dryer of the tumble dryer may use other heating means such as a solar heating structure in addition to a heater or a heat pump system, the air duct uses an internal condensing-heating circulation structure (see FIG. 12 and FIG. 13). Air duct structure in which hot and humid air after drying is discharged to the outside can be adopted.

Embodiment 5

Figure 15:
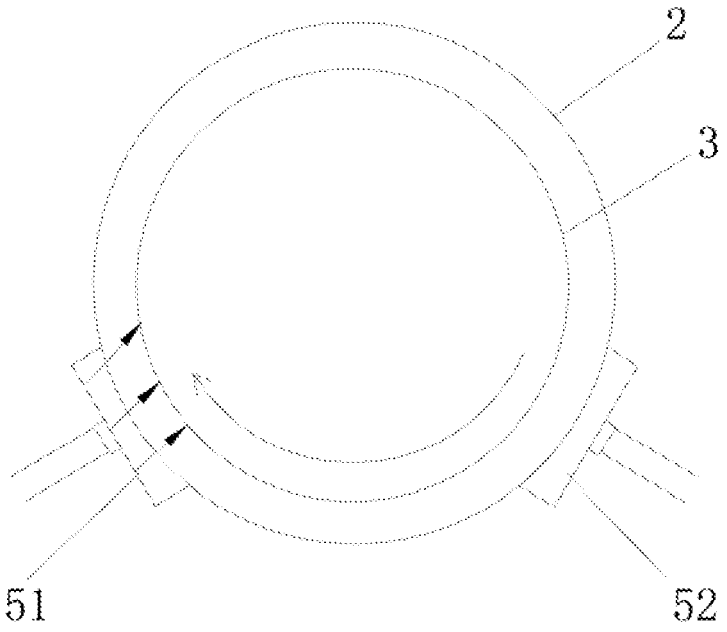

As shown in FIG. 15, the second drying system of the present disclosure comprises a first air chamber 51 located on the left side of the outer drum 2, and a second air chamber 52 located at the right side of the outer drum 2, the left side and the right side of the outer drum 2 are defined with respect to the direction in which the user is facing to the clothes dispensing opening of the dryer. The air supply direction respectively corresponds to the rising and falling path of the clothes driven by the rotation of the inner drum, that is, the inner drum is switched between the forward and reverse rotation, and the first air chamber 51 and the second air chamber 52 correspond to the rising and falling paths of the clothes.

During the drying process, when the inner drum 3 is rotated forwardly which is clockwise, the clothes rise on the left side of the inner drum 3, and fall on the right side of the inner drum 3. At this time, the first air chamber 51, which blows air corresponding to the clothes rising side path, is opened, and the second air chamber 52 on the other side is closed (see FIG. 15). On the other hand, when the inner drum 3 rotates reversely which is counterclockwise, the clothes rise on the right side of the inner drum 3, and fall on the left side of the inner drum 3. At this time, the second air chamber 52, which blows air corresponding to the clothes rising side path, is opened, and the first air chamber 51 on the other side is closed (see FIG. 14). The first air chamber 51 and the second air chamber 52 are repeatedly switched on and off in response to the forward and reverse rotation of the inner drum 3.

Embodiment 6

Figure 14:
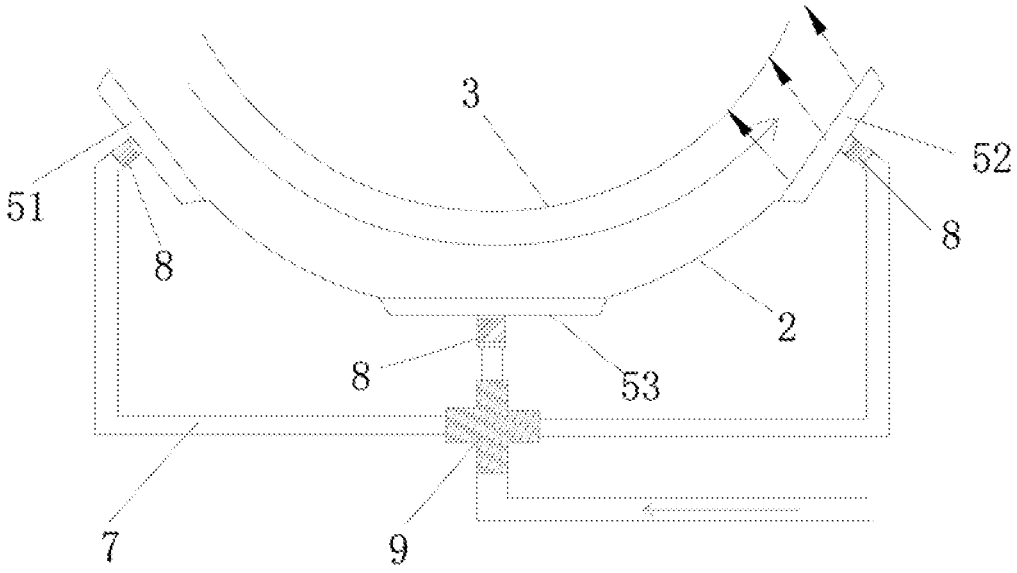
FIG. 14 and FIG. 15 are diagrams of different embodiments of mounting structures of air chambers and an outer drum of another tumble dryer of the present disclosure.

As shown in FIG. 14, the dryer of the present embodiment is further provided with a third air chamber 53 on the basis of the embodiment 5 (see FIG. 8), the third air chamber 53 is arranged at the bottom of the outer drum 2, that is, directly below, and the blowing direction is upward. Regardless of whether the inner drum 3 is rotated forwardly or reversely, the clothes always fall in the lower part and lift upwardly from the lower part, and the angles at which each clothes fall are different. The third air chamber 53 can supply hot air continuously or intermittently for a long period of time, and the drying time can be further saved.

Embodiment 7

Figure 1:
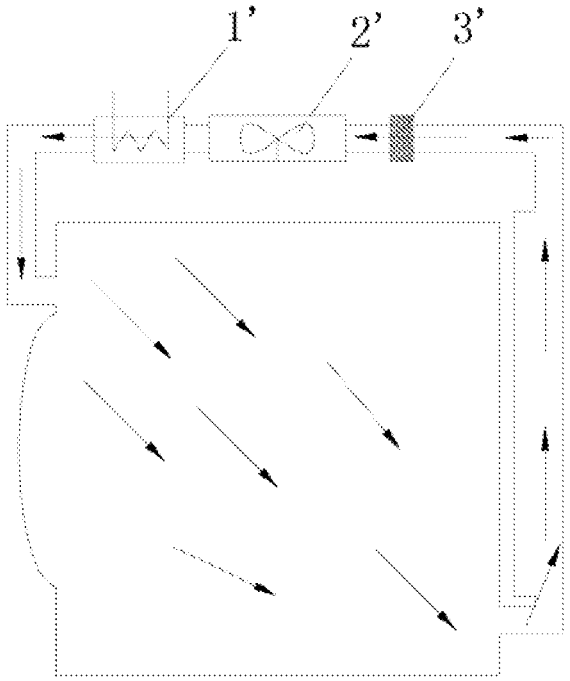
FIG. 1 is a schematic diagram of an existing heating tube dryer.
Figure 2:
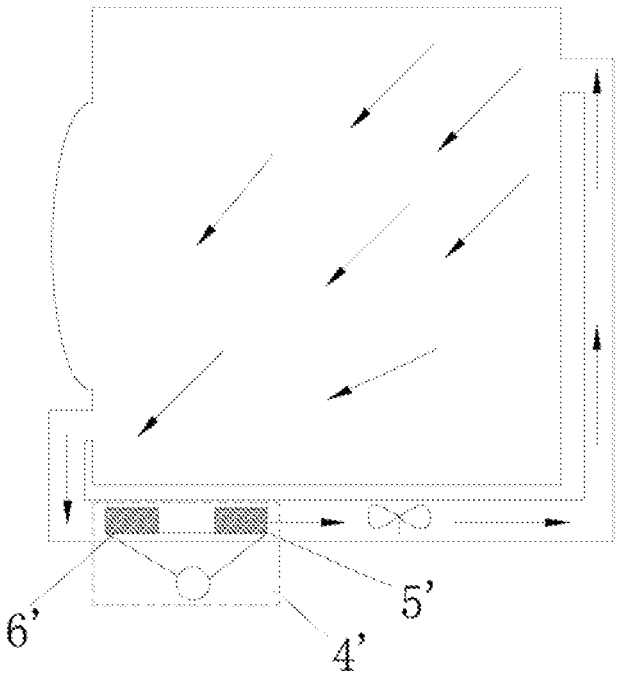
FIG. 2 is a schematic diagram of an existing heating pump dryer.

As shown in FIG. 1 and FIG. 13, the clothes dryer of the present embodiment is further improved on the basis of the embodiment 5, and the first air chamber 51 is located on the left side of the outer drum 2 and rear end thereof in the axial direction, and opposite to the end of the clothing dispensing opening 6. The second air chamber 52 is located on the right side of the outer drum 2 and front end thereof in the axial direction, and is close to the end of the clothing dispensing opening 6. The two chambers cover at least 60% of the area in the axial direction. During the drying process, the inner drum is switched to rotate forwardly and reversely, the first air chamber and the second air chamber are open/close corresponding to the clothes rising and falling. It achieves that air intake from the side wall of the outer drum at the front and rear ends of the outer drum and makes clothes evenly dry and not cause damage to clothes, drying time is also reduced.

Further, in combination with the embodiment 6, the third air chamber 53 provided on the outer drum is located at the bottom of the outer drum 2, and in the axial middle position, that is, the third air chamber 53 is located at a position between the first air chamber 51 and the second air chamber 52 in the axial direction of the outer drum 2. The three chambers cover at least 80% of the area in the axial direction, or are completely covered. The opening and the closing of the first air chamber and the second air chamber is controlled according to the clothes rising and falling which is driven by the rotation direction, the third air chamber can supply hot air continuously or intermittently for a long period of time.

The first air chamber and the second air chamber are not fixed at the rear left end or the front right side in the present embodiment, they may be arranged at the front left end or the rear right end. Or the third air chamber is at the front and rear ends, the first air chamber or the second air chamber is in the middle or other positions.

Embodiment 8

As shown in from FIG. 12 to FIG. 14, on the basis of the embodiment 7, in the early drying stage, the inner drum 3 of the clothes dryer rotates clockwise or rotates clockwise most of the time (see FIG. 15). The rotation of the inner drum 3 causes the clothes to tumble, the clothes fall on the right side of the inner drum 3 and rise on the left side, and the clothes on the left side are in a stacked state. The first air chamber 51 opening and the second air chamber 52 closing, air intake from the rear end near the left side of the outer drum 2 so that the clothes at the rear side of the inner drum 3 is quickly dried. As shown in FIG. 14, in the late drying stage, the inner drum 3 of the clothes dryer rotates counterclockwise or rotates counterclockwise most of the time. The rotation of the inner drum 3 causes the clothes to tumble, the clothes fall on the left side of the inner drum 3 and rise on the right side, and the clothes on the right side are in a stacked state. The second air chamber 52 opening and the first air chamber 51 closing, air intake from the front end near the right side of the outer drum 2 so that the clothes on the front side of the inner drum 3 are collectively dried. The control method cooperates with the first drying system covering a full range of drying to avoid fibers of local clothes losing their elasticity due to over-drying or easily being broken that causing clothing worn out.

Further, a mid-drying stage can be added, controls the opening/closing switching of the first air chamber 51 and the second air chamber 52 and adjust the proportion of time in which the inner drum rotates forward and backward. Or the third air chamber 53 is opened to in the mid-drying stage and the first air chamber 51 and the second air chamber 52 on the left and right sides are closed. Or the third air chamber 53 respectively cooperates with the first air chamber 51 and the second air chamber 52 to blow air drying in the mid-drying stage.

Drying time segment can be separated in accordance with the temperature rise stage, the temperature stable stage and the second stage of temperature rise of the existing drying process, or according to the detected humidity, or temperature changes. For example: in the early drying stage, the heat of the drying clothing causes the temperature to rise rapidly to about 50° C.; then the rising rate of the temperature is gradually slow and steady. This stage is the period when the water vapor evaporates most, the heat is absorbed by the water and water is evaporated, while the temperature inside the drum rises relatively slowly. In the late drying stage, only a small amount of water is inside the drum, the temperature rise rate inside the drum will once again sharply increase, this time means close to the end of drying.

Embodiment 9

As shown in from FIG. 3 to FIG. 5 and FIG. 14, the two types of tumble dryers of the present disclosure comprise a drying structure of a washing dryer. A one-way valve 8 is provided on an inlet pipe 7 of each air chamber 5, the one-way valve 8 prevents the flow of water from entering the heating unit or prevents the wash water from leaking when the machine is in washing process. Each chamber 5 is in communication with the air duct through a same air distribution valve 9, the air chambers is controlled to open and close by the air distribution valve 9. Or, each air chamber is respectively connected with the air duct, and each air chamber is correspondingly provided with an open control valve.

Figure 10:
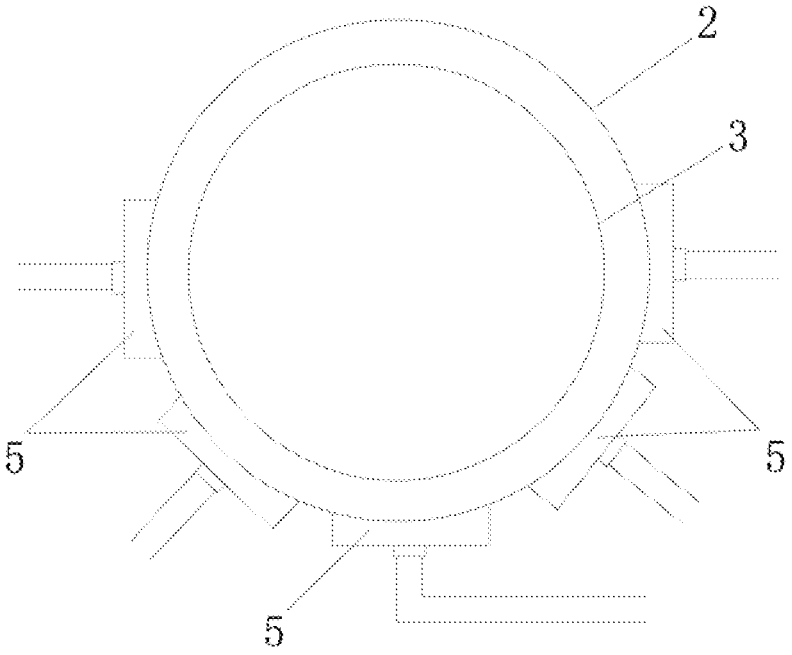

As shown in from FIG. 8 to FIG. 10, the number of the air chambers 5 provided in the above mentioned two types of tumble dryers of the present disclosure is not limited to the two or three, but four or five or more. They can be added not only in the circumferential direction of the outer drum but also in the axial direction.

Figure 6:
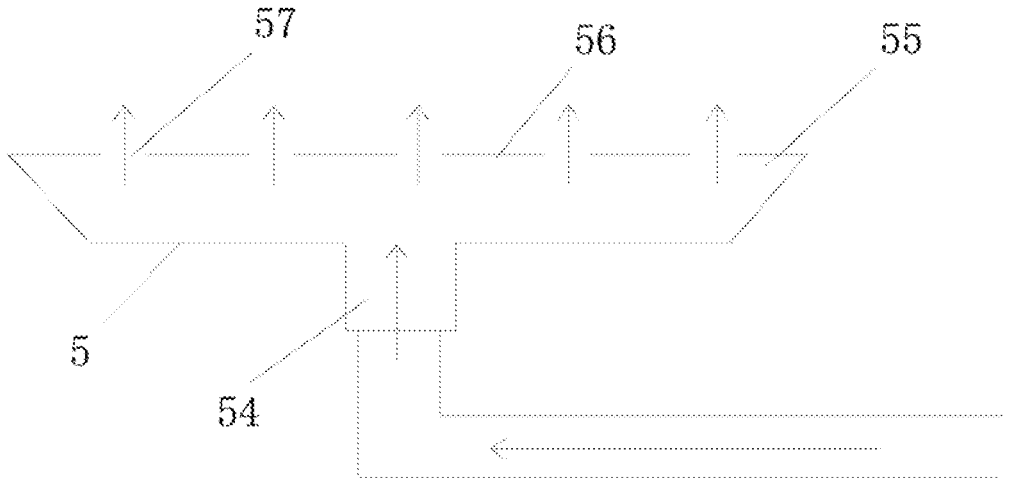
FIG. 6 is a schematic diagram of an air chamber of the present disclosure.
Figure 7:
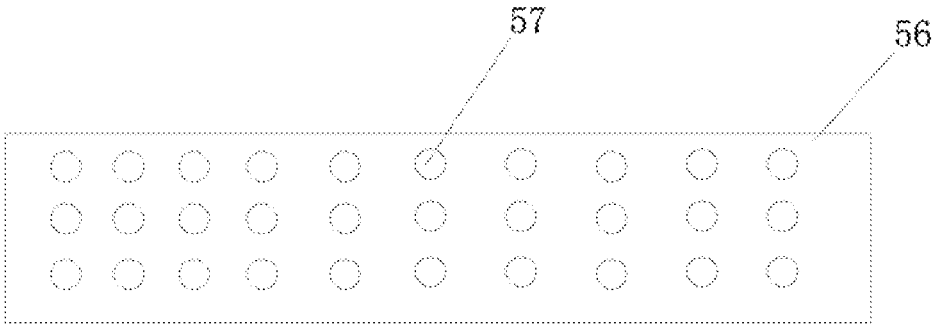
FIG. 7 is a schematic diagram of a vent cover of the present disclosure.

As shown in FIG. 6 and FIG. 7, the air chamber 5 comprises an air inlet 54 and an opening 55, and a vent cover 56 for blowing air is arranged on the opening 55. The vent covers 56 is evenly distributed with a plurality of vent holes 57. The air intake is evenly and not forming turbulence.

The above description is only preferred embodiments of the disclosure. It should be noted that without departing from the design concept of the present disclosure, various variations and improvements made to the technical solutions of the present disclosure by persons skilled in the art all belong to the protection scope of the present disclosure.

The invention claimed is:

1. A tumble dryer, comprising:

an inner drum;

an outer drum;

an air heating and supplying means and an air duct;

wherein, the dryer includes:

a first air chamber;

a second air chamber, wherein the first air chamber and the second air chamber are respectively located on a left side and a right side of the outer drum for blowing hot air from a side wall of the outer drum to the inner drum, each air chamber communicates with the air duct and is configured to be controlled to open and close independently, an air supply direction respectively corresponds to a rising and falling path of the clothes by a rotation of the inner drum, wherein during drying, the inner drum is configured to rotate forwardly and reversely, the opening and closing of the air chambers is configured to be switched so that the air chamber corresponding to a clothes falling path is open to supply air, the other air chamber is closed; and a third air chamber on a bottom of the outer drum and configured to have an upward blowing direction.

2. The tumble dryer according to claim 1, wherein, all air chambers are distributed in an order of front and rear of the outer drum in an axial direction.

3. The tumble dryer according to claim 2, wherein, an opening and closing of each air chamber and the rotation direction of the inner drum are configured to be controlled in accordance with a drying time and/or a temperature inside the outer drum and/or a humidity of the clothes.

4. The tumble dryer according to claim 1, wherein, the first chamber and the second chamber are respectively located at a front end and a rear end of the outer drum, the third air chamber is arranged in a middle.

5. The tumble dryer according to claim 1, comprising:

a one-way valve provided on an inlet pipe of each air chamber, each chamber is in communication with the air duct through a same air distribution valve, the air chambers are configured to be controlled to receive air by the air distribution valve, or each air chamber is respectively connected with the air duct, and each air chamber is correspondingly provided with an open control valve.

6. The tumble dryer according to claim 1, wherein, each air chamber comprises an air inlet and an opening, and a vent cover for blowing air is arranged on the opening, the vent cover is evenly distributed with a plurality of vent holes.

7. A drying method of the tumble dryer according to claim 1, wherein, all air chambers are distributed in an order of front and rear of the outer drum in an axial direction of the outer drum, the rotation direction of the inner drum is controlled according to the distribution order of each air chamber so as to supply air in front or rear positions of the inner drum for drying in different drying stages.

8. The drying method according to claim 7, wherein, the method comprises at least two stages which is an early drying stage and a late drying stage, the air chamber which blows air from a left side of the outer drum is also located at a rear end of the outer drum, and the air chamber which blows air from a right side of the outer drum is also located at a front end of the outer drum, during the early drying stage, the inner drum rotates counter-clockwise for a whole stage or most of the time, the clothes on the left side fall, the air chamber on the left side is open to supply air, the air chamber on the right side is closed;

during the late drying stage, the inner drum rotates clockwise for a whole stage or most of the time, the clothes on the right side fall, the air chamber on the right side is open to supply air, the air chamber on the left side is closed.

9. The drying method according to claim 8, wherein, a lower air chamber is provided at a middle position on a lower part of the outer drum, the lower air chamber cooperates with the air chambers on both left and right sides of the outer drum to dry the clothes during the early and late drying stages, or, a mid-drying stage is added, the lower air chamber is open during the mid-drying stage, the air chambers on the left and right sides of the outer drum are closed.

10. A tumble dryer, comprising:

an inner drum;

an outer drum; and a first drying system in which air is blown in from a front/rear of the outer drum, a second drying system, including:

a first air chamber;

a second air chamber, wherein the first air chamber and the second air chamber are configured for blowing hot air from a side wall of the outer drum to the inside, the first air chamber and the second air chamber are respectively located on a left side and a right side of the outer drum, and correspond to a rising and falling path of the clothes driven by a rotation of the inner drum, and each air chamber configured to be independently controlled to blow hot air in, and during drying, the inner drum is configured to rotate forwardly and reversely, the opening and closing of the air chambers is configured to be switched so that the air chamber corresponding to a clothes falling path is open to supply air, the air chamber on the other side is closed; and a third air chamber installed on a bottom of the outer drum, and configured to have an upward blowing direction.

11. The tumble dryer according to claim 10, wherein, the first drying system is a main drying system, and the second drying system is an auxiliary drying system, wherein during drying the second drying system is configured to control the opening and closing of the air chambers with the first drying system to complete the drying.

12. The tumble dryer according to claim 10, wherein, all air chambers are distributed in the order of front and rear in an axial direction of the outer drum, and/or each air chamber is distributed in the circumferential direction of the outer drum.

13. The tumble dryer according to claim 10, wherein, the first chamber and the second chamber are respectively located at a front end and a rear end of the outer drum.

14. The tumble dryer according to claim 10, comprising:

a one-way valve provided on an inlet pipe of each air chamber, each air chamber is in communication with the air duct through a same air distribution valve, and the air chambers are configured to be controlled to receive air by an air distribution valve, or each air chamber is respectively communicated with the air duct, and each air chamber is correspondingly provided with an open control valve.

15. The tumble dryer according to claim 10, wherein, the second drying system shares an air supplying means with the first drying system, and air is diverted to the first drying system and the second drying system through the air duct, or the second drying system and the first drying system are respectively connected to a corresponding heating means.

* * * * *